US005588714A

United States Patent [19]

Boucherie

[11] Patent Number: 5,588,714

[45] Date of Patent: Dec. 31, 1996

[54] METHOD FOR MANUFACTURING BRUSHES

[75] Inventor: Leonel P. Boucherie, Ambachtenstraat, Belgium

[73] Assignee: Firma G. B. Boucherie, naamloze vennootschap, Belgium

[21] Appl. No.: 436,008

[22] Filed: May 5, 1995

[30] Foreign Application Priority Data

May 9, 1994 [BE] Belgium ..... 09400479

[51] Int. Cl.[6] ..... A46D 3/04

[52] U.S. Cl. ..... 300/21

[58] Field of Search ..... 300/2–11, 21; 264/243; 15/167.1

[56] References Cited

U.S. PATENT DOCUMENTS 3,093,416 6/1963 Schmidt .

5,104,196 4/1992 Boucherie ..... 300/5

FOREIGN PATENT DOCUMENTS 0563419 6/1993 European Pat. Off. .

2731762 1/1979 Germany .

3018178 11/1981 Germany .

*Primary Examiner*—Mark Rosenbaum

*Attorney, Agent, or Firm*—Bacon & Thomas

[57] ABSTRACT

A method for manufacturing brushes, whereby brush bodies (2) which are provided with openings (12) according to a specific hole pattern are supplied to a filling station (6), whereat bundles of fibres (7) are supplied to the openings (12) at this filling station (6). Each brush body (2) is successively presented to at least two filling tools (13–14) at each filling station (6), whereby each filling tool (13–14) fills the entire hole pattern with bundles of fibres (7) in different steps, and whereby at each step, each of the filling tools (13–14) fills the same part (A–B) of said hole pattern in different brush bodies (2).

9 Claims, 7 Drawing Sheets

METHOD FOR MANUFACTURING BRUSHES

BACKGROUND OF THE INVENTION

The present invention concerns a method for manufacturing brushes, in particular of the type whereby brush bodies which are provided with openings are supplied to a filling station, and bundles of fibres are inserted in the openings at this filling station.

As a first example, the process is intended for the manufacturing of tooth brushes, but in general it can also be used for manufacturing other brushes.

It is known that the output of a brush manufacturing machine strongly depends on the continuity with which the brush bodies and brushes can be carried through the different processing stations.

BRIEF SUMMARY OF THE INVENTION

The invention has an objective a method for manufacturing brushes whereby this continuity is optimally guaranteed and a high output is obtained.

To this end, the invention constitutes a method of the above-mentioned type, wherein each brush body is successively presented to at least two filling tools in the filling station, whereby each filling tool fills the entire hole pattern with bundles of fibres in different steps, and whereby at each step, each of the filling tools fills the same part of said hole pattern in different brush bodies.

The number of filling tools used is preferably equal to the number of steps in which each brush body is filled.

Preferably, the brush bodies which are positioned in front of the filling tools, as well as any brush bodies possibly situated in between, are held on a common moveable support during the filling, such that the filling tools only have to carry out a filling movement.

According to the most preferred embodiment, each filling tool will alternately fill different parts of the succeeding brush bodies, which offers the advantage that the filling tools can be placed symmetrically in relation to one another, so that the use of a common drive does not cause any problems.

BRIEF DESCRIPTION OF THE DRAWINGS

In order to better explain the characteristics of the invention, the following preferred embodiment is given as an example only without being limitative in any way, with reference to the accompanying drawings, where.

DETAILED DESCRIPTION OF PREFERRED EMBODIMENT OF THE INVENTION

Figure 1:
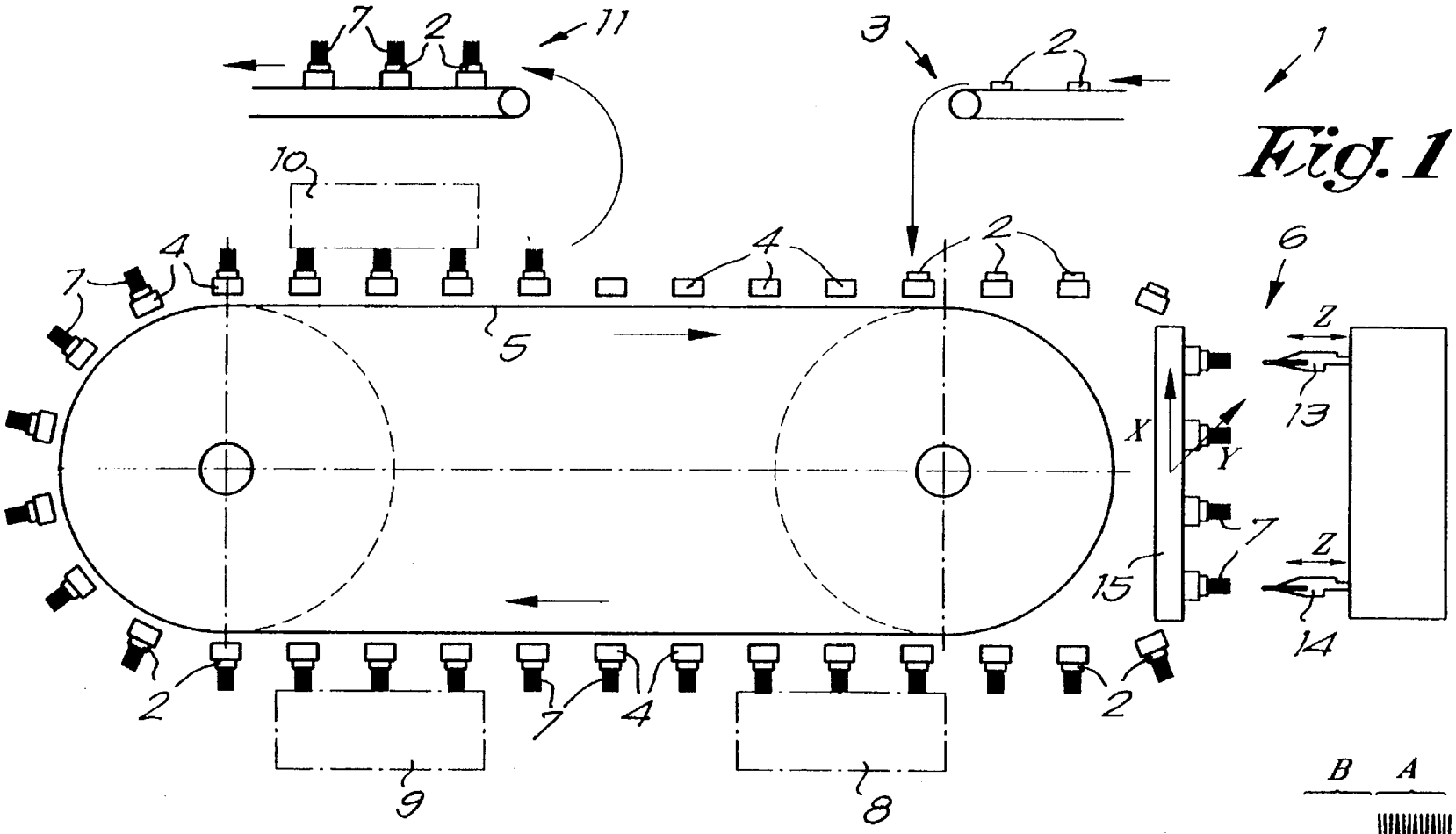
FIG. 1 is a schematic representation of a brush manufacturing machine which is used to carry out the method according to the invention.
Figure 4:
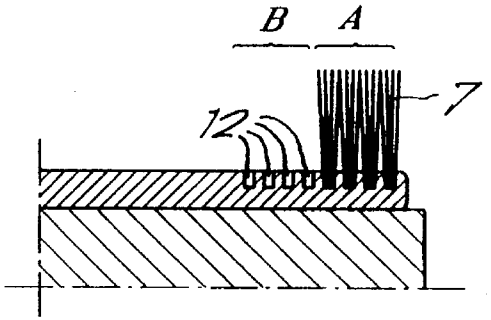
FIG. 4 shows a section view taken along line IV—IV in FIG. 3.

FIG. 1 is a schematic representation of a brush manufacturing machine 1. Hereby, brush bodies 2 are joined with brush body holders 4 by means of a supply mechanism 3 which cooperate with an endless conveyor element 5, such as a chain or the like. The conveyor element 5 brings the brush body holders 4 with the brush bodies 2 provided therein to different processing stations, including at least a filling station 6 where bundles of fibres 7, designed to form the brush hairs, (i.e. bristles) are provided in the brush bodies 2. Further, other processing stations can be provided, such as cutting stations 8 where the bundles of fibres 7 are cut at the required length, stations 9 where the far ends of the brush hairs are rounded off, a cleaning station 10 and possibly also other stations, for example for branding, for quality control, etc. Finally, the brush bodies 2 are removed by means of removal means 11.

A device with such an endless conveyor element 5 is already known from EP 563.419.

Figure 3:
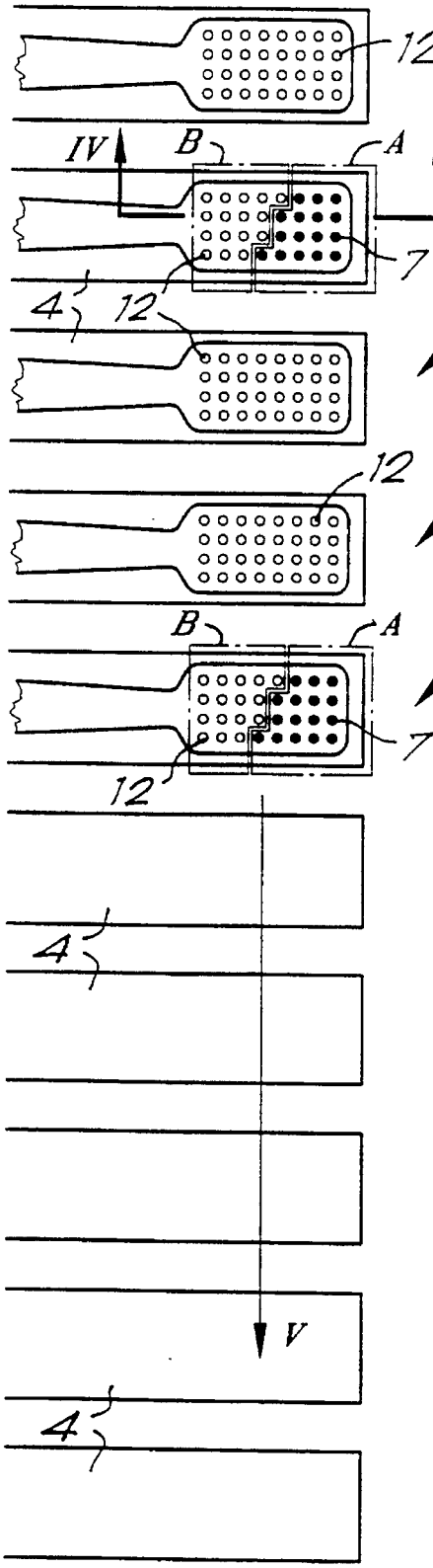
FIG. 3 shows a section view taken along line III—III in FIG. 2.
Figure 2:
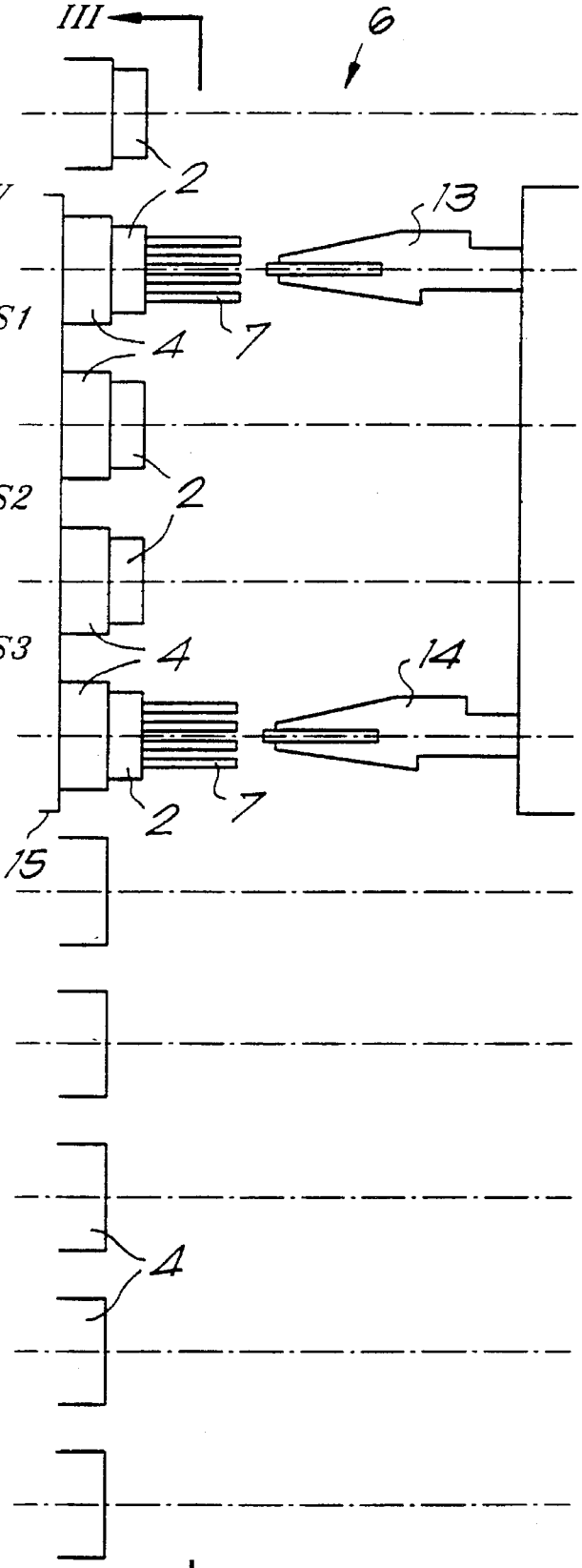
FIG. 2 is a schematic representation of the filling tools shown in FIG. 1 and a number of brush bodies placed in front of it.

As shown in the FIGS. 1 to 3, the bundles of fibres 7 are provided in the brush bodies 2 in a known manner, since the brush bodies 2 with the openings 12 provided therein are placed in front of filling tools 13 and 14 which fill the brush bodies 2, in other words put bundles of fibres 7 in the above-mentioned openings 12.

The invention is unique in that each brush body 2 is successively presented to several filling tools in the filling station, in this case two, which each fill a part, the parts A and B in the embodiment represented in FIG. 3, of the brush body 2. The brush bodies 2 situated opposite the filling tools 13–14 are moved synchronously and each filling tool 13–14 fills the entire hole pattern with bundles of fibres 7 in different steps. At each step, each of the filling tools 13 and 14 fills the same part, A or B respectively, of this hole pattern in different brush bodies 2.

As shown in FIG. 1, the brush bodies 2 which are positioned in front of the filling tools 13–14, as well as any brush bodies 2 possibly situated in between the filling tools 13–14, are held on a common moveable support 15 during the filling which carries out the positioning movements X and Y, and possibly also Z, for the filling tools 13–14. The filling tools 13–14 preferably only carry out a back and forth movement Z which is perpendicular to the plane formed by X and Y.

In the case where, as represented in the figures, use is made of two filling tools 13–14, a part—A or B—of each brush body 2 which corresponds to almost half of it, is filled by the one filling tool 13, after which the remaining part, B or A respectively, is filled by the other filling tool 14.

The brush bodies 2 are conveyed in steps through the filling station 6. Preferably, the number of so-called indexes to convey a brush body 2 from a filling tool 13 to a subsequent filling tool 14 is an odd number.

As shown in FIG. 2, the movement of the brush bodies 2 between the filling tools 13 and 14 is preferably carried out with three indexes, S1, S2 and S3 respectively.

Figure 6:
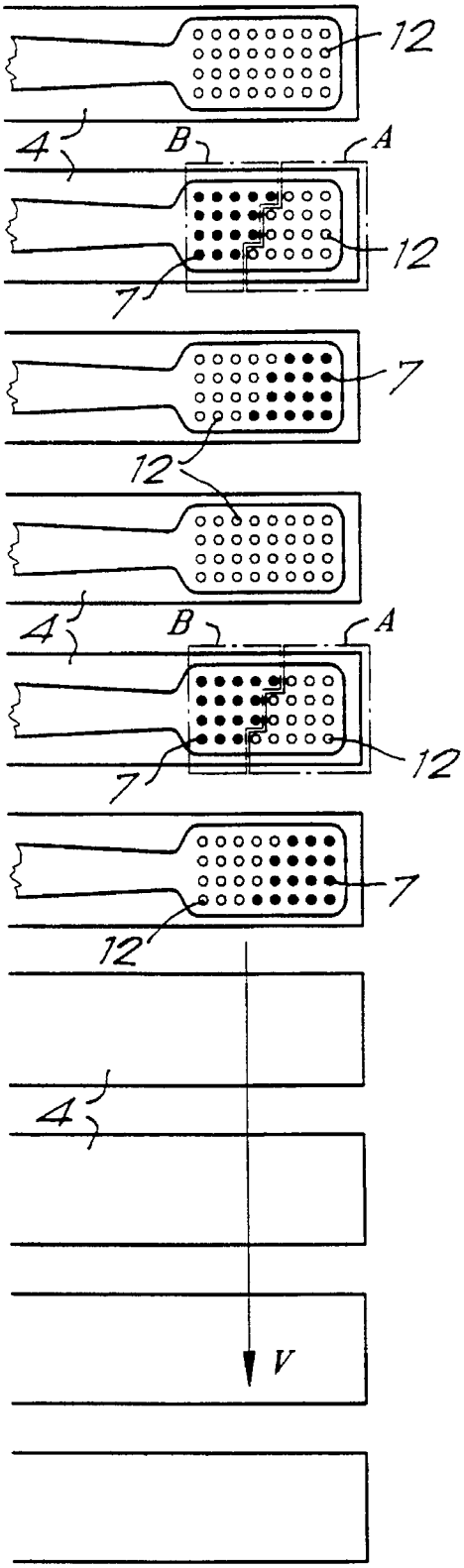
FIGS. 5–6, 7–8, 9–10, 11–12 and 13–14 show views for different positions which are analogous to those depicted in FIGS. 2 and 3.
Figure 5:
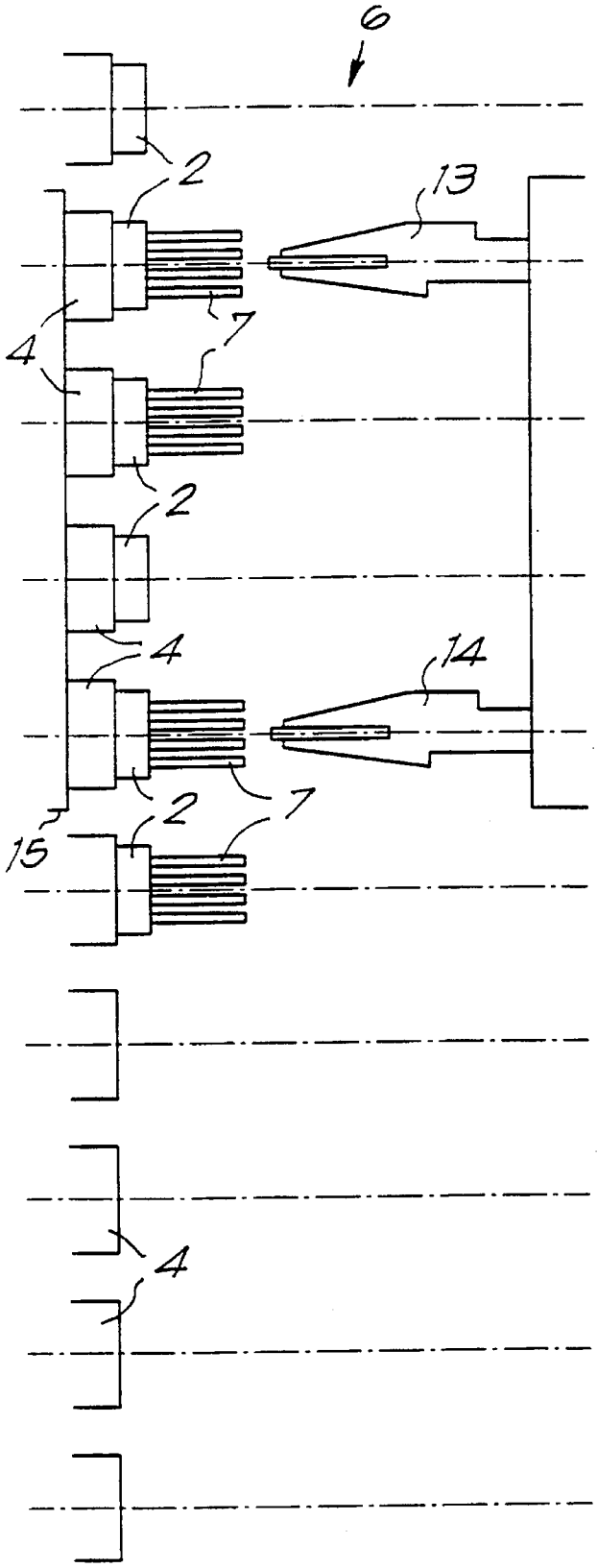
Figure 8:
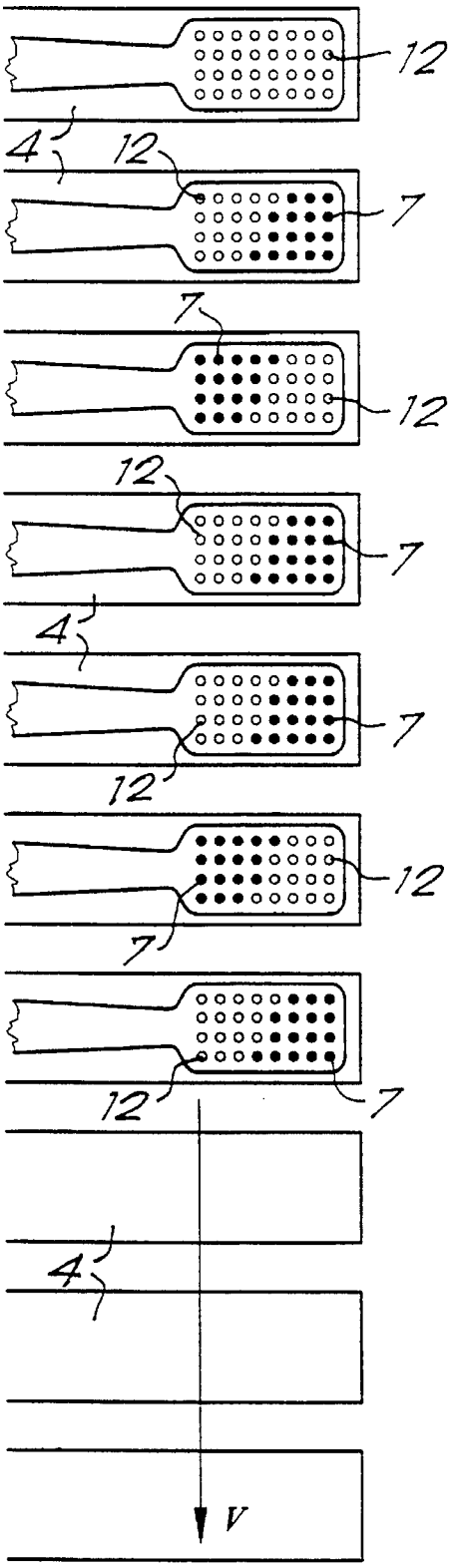
Figure 7:
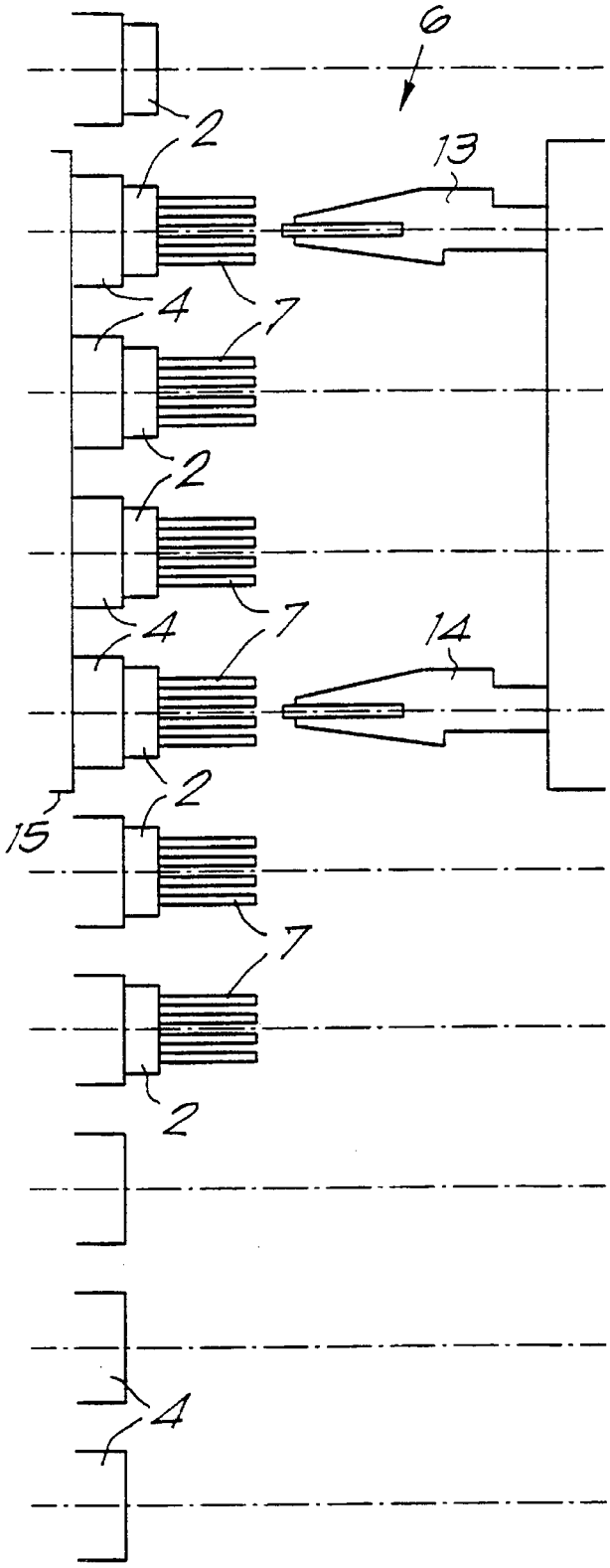
Figure 10:
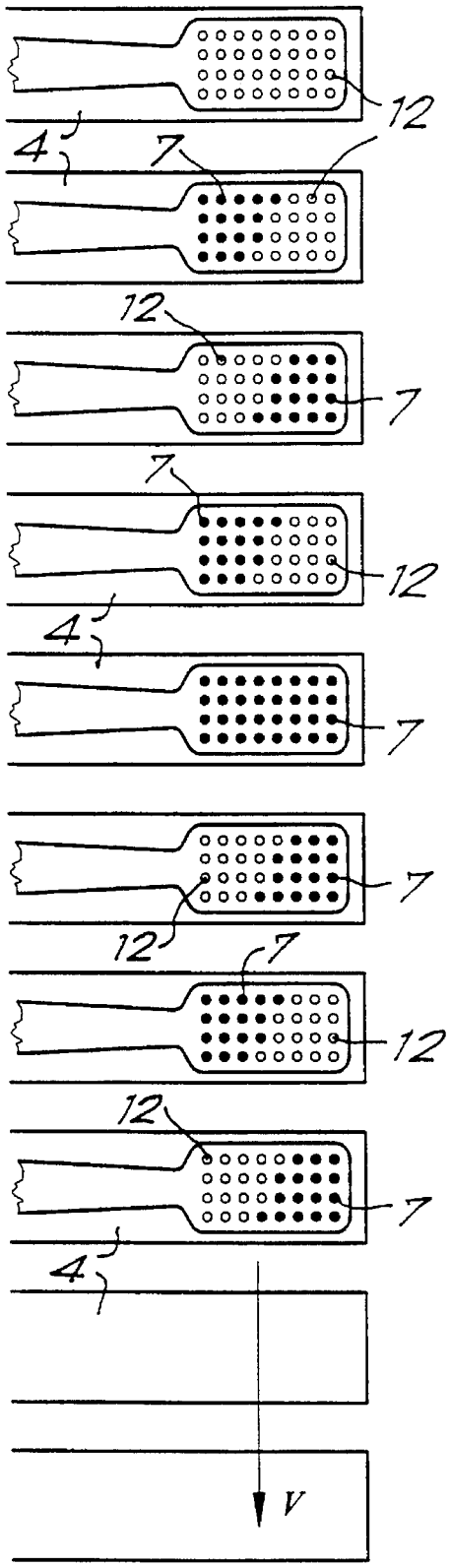
Figure 9:
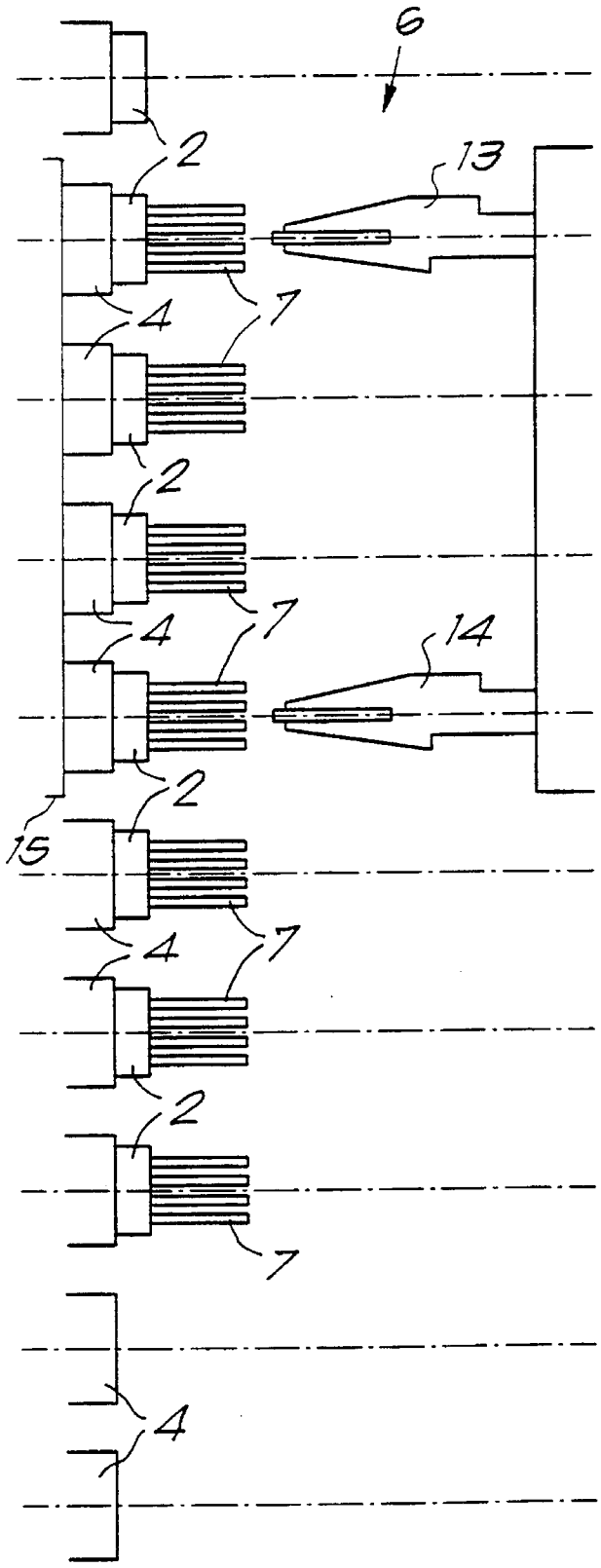
Figure 12:
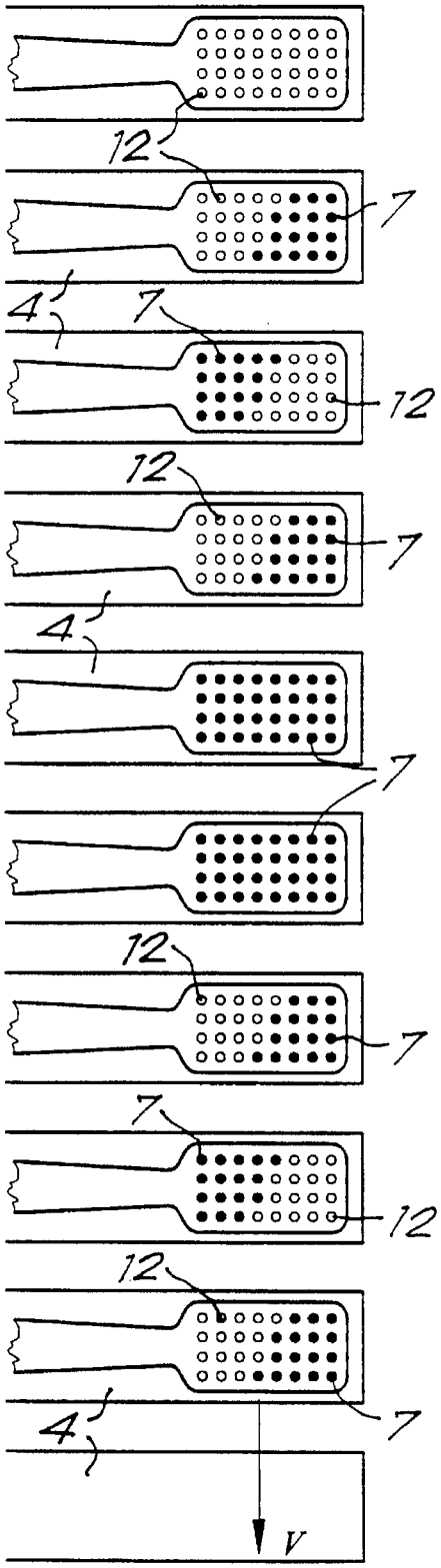
Figure 11:
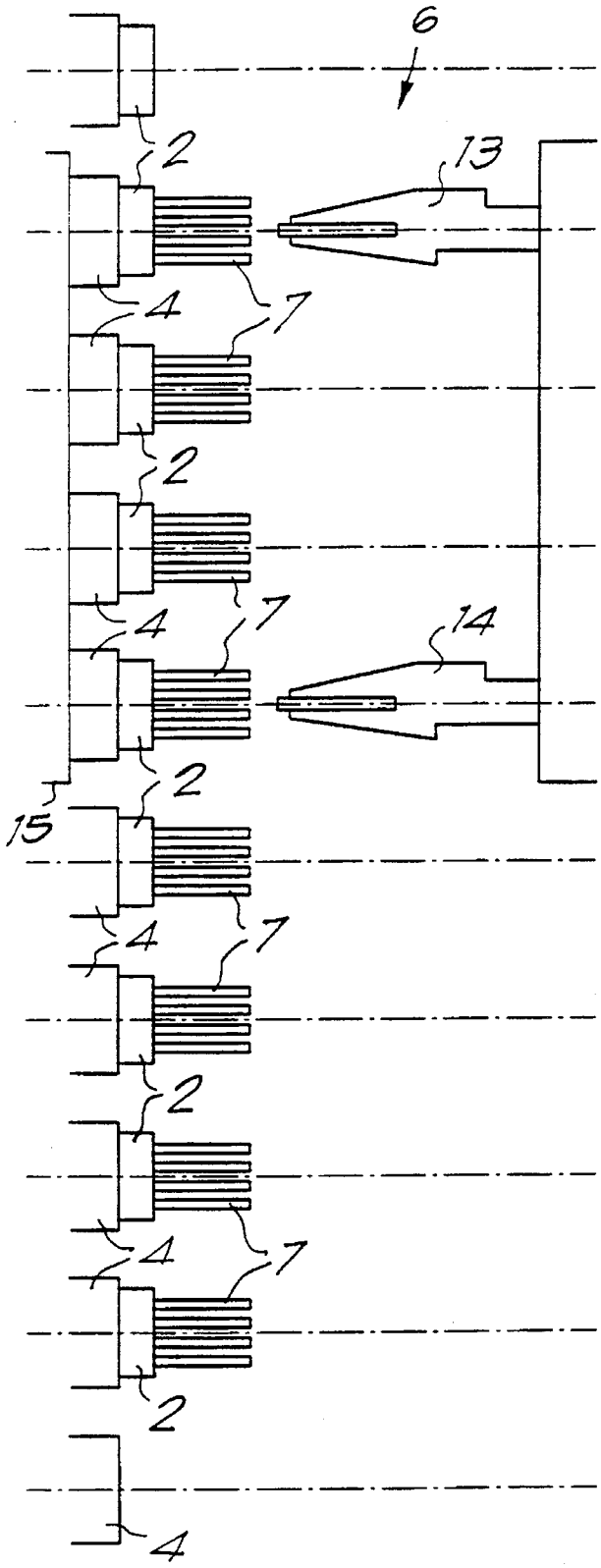
Figure 14:
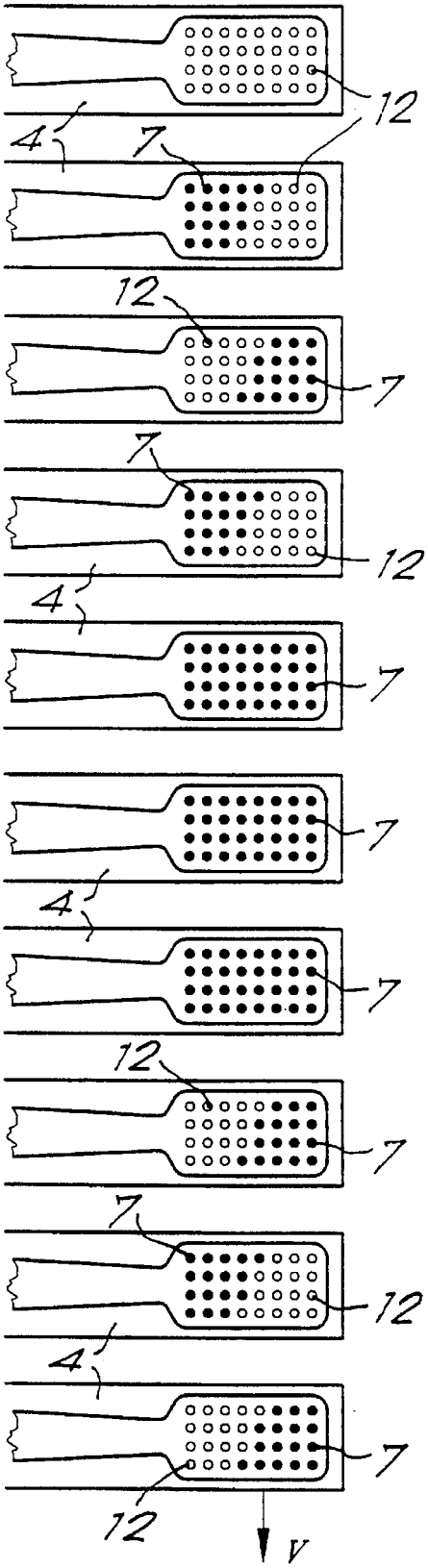
Figure 13:
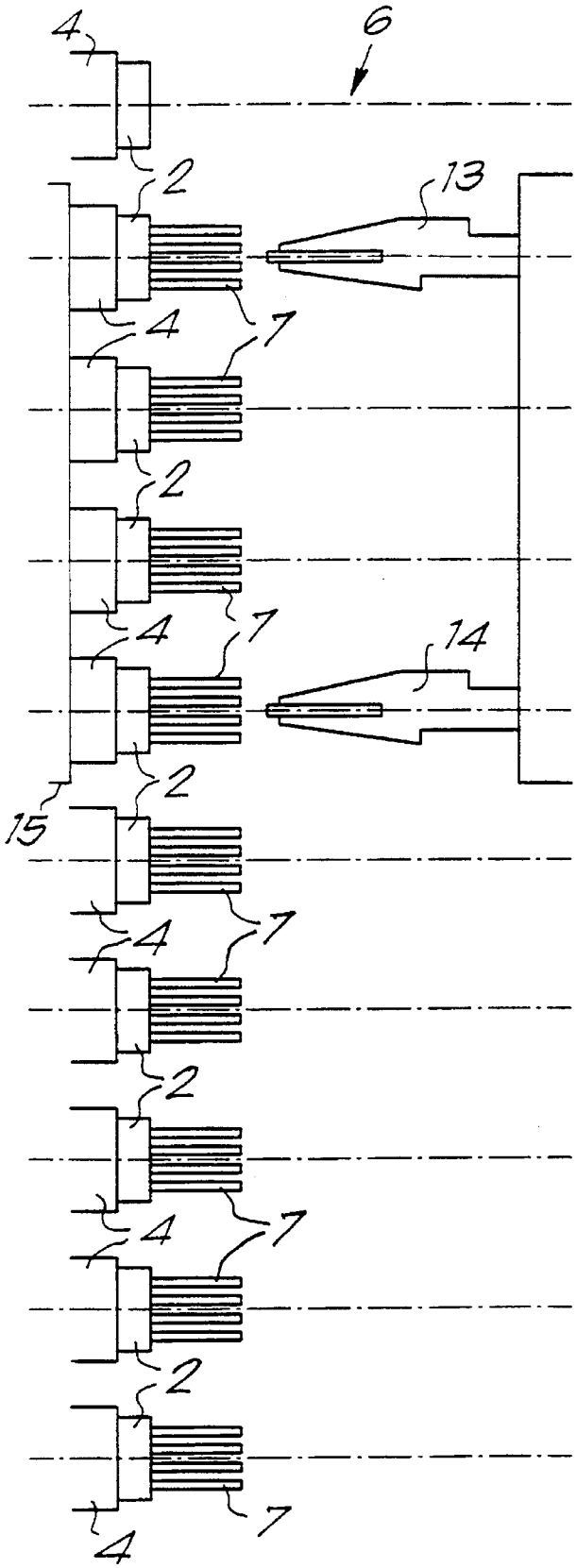

As shown in the FIGS. 2 to 14, different parts of the succeeding brush bodies 2 are preferably alternately filled at each filling tool 13 and 14. This implies that the filling tools 13 and 14, as shown in the FIGS. 2 and 3, first provide the parts A of the brush bodies 2 presented to them with bundles of fibres, and at a following step, as shown in the FIGS. 5 and 6, provide the parts B of the subsequent brush bodies 2 with bundles of fibres 7, and further alternately so.

As represented in the FIGS. 7 to 14, brush bodies 2 are finally obtained of which both the parts A and B are provided with bundles of fibres.

Depending on how the process was started, as shown in the FIGS. 9 to 14, the first three brushes will not be completed filled after each start and they are to be regarded as waste.

The above-mentioned method allows for very rapid filling and also makes sure that the brush bodies 2 only need to be present under a filling tool 13 or 14 for a short while, so that they can be moved in steps at very short intervals.

It is clear that the invention is not restricted to brush manufacturing machines of the type whereby the movement along the different processing stations is carried out by means of an endless conveyor element 5.

It is also clear that there can be more than two filling tools, for example three, whereby in this case each filling tool provides ⅓ of a brush body with bundles of fibres.

The present invention is by no means restricted to the embodiment described as an example and represented in the drawings, whereas a method for manufacturing brushes can be realized according to several variants while still remaining within the scope of the invention.

I claim:

1. In a method for manufacturing brushes in which brush bodies having fiber receiving openings arranged in a specific hole pattern are supplied to a filling station having at least two filling tools whereat bundles of fibers are inserted by the filling tools in the openings, the improvement comprising the steps of:

successively presenting each brush body to the at least two filling tools such that each filling tool fills only a portion of the entire hole pattern of each brush body presented to it for filling, with the portions filled by the filling tools being different but complimentary to each other so that the filling tools collectively in succeeding steps insert fibers into the entire hole pattern of each brush body supplied to the filling station;

each filling tool filling a different portion of the hole pattern of each successive brush body presented to it for filling.

2. A method according to claim to claim 1, including using a number of filling tools at said filling station that is equal to the number of steps required to completely fill the hole pattern in each brush body by the filling tools.

3. A method according to claim 1, including supported the brush bodies to be presented to the filling tools by means of a common moveable support during the filling steps.

4. A method according to claim 1, including the step of presenting different portions of successive brush bodies alternatively to each filling tool wherein each filling tool alternately fills each of the different portions of successive brush bodies such that each filling tool operates over the entire hole pattern of successive brush bodies.

5. A method according to claim 1, including using only two filling tools at said filling station.

6. A method according to claim 5, including moving the brush bodies in successive steps through the filling station such that the number of steps required to convey a brush body from one filling tool to the next filling tool is an odd number.

7. A method according to claim 6, wherein the number of steps is three.

8. A method according to claim 5, wherein a first portion of each brush body hole pattern corresponding to substantially half of the hole pattern is filled by one filling tool, and the remaining portion of the hole pattern is then filled by the other filling tool.

9. A method according to claim 1, including supporting the brush holders by brush body holders mounted on an endless conveyor element; moving the brush holders and brush bodies along successive processing stations, one of which is said filling station; temporarily removing the brush holders and brush bodies from the endless conveyor element at the filling station and placing them on a movable support; moving the brush holders and brush bodies on said movable support so as to position the brush bodies with their openings in front of the respective filling tools; and removing the brush bodies after they have been moved along said processing stations.

* * * * *